US007195004B2

(12) United States Patent
Scollard et al.

(10) Patent No.: US 7,195,004 B2
(45) Date of Patent: Mar. 27, 2007

(54) FUEL INJECTOR CUP WITH IMPROVED LEAD-IN DIMENSIONS FOR REDUCED INSERTION FORCE

(75) Inventors: Joseph Edward Scollard, Cumming, GA (US); Stephen C. Bugos, Poquoson, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 318 days.

(21) Appl. No.: 10/253,476

(22) Filed: Sep. 25, 2002

(65) Prior Publication Data

US 2004/0055578 A1 Mar. 25, 2004

(51) Int. Cl.
*F02M 37/04* (2006.01)

(52) U.S. Cl. ..... 123/470; 123/468

(58) Field of Classification Search ..... 123/470, 123/469, 468, 456, 509; 29/888.011, 888.01, 29/525

See application file for complete search history.

(56) References Cited

U.S. PATENT DOCUMENTS

| | | | | |
|---|---|---|---|---|
| 3,965,620 A | | 6/1976 | Dreher | 51/164 |
| 4,286,563 A | * | 9/1981 | Fahim et al. | 123/469 |
| 4,647,012 A | * | 3/1987 | Gartner | 251/148 |
| 4,709,507 A | | 12/1987 | Musschoot | 51/7 |
| 4,712,333 A | | 12/1987 | Lofton | 51/164.5 |
| 5,018,499 A | | 5/1991 | Usui | 123/456 |
| 5,109,633 A | | 5/1992 | Durnil | 51/163.1 |
| 5,140,783 A | | 8/1992 | Hoffman | 51/313 |
| 5,676,588 A | | 10/1997 | Frederick et al. | 451/86 |
| 5,724,946 A | | 3/1998 | Franchitto | 123/470 |
| 5,829,131 A | | 11/1998 | DeSloover et al. | 29/888.1 |
| 5,873,770 A | | 2/1999 | Hashimoto | 451/32 |
| 5,983,869 A | * | 11/1999 | Cooke et al. | 123/514 |
| 6,165,059 A | | 12/2000 | Park | 451/330 |
| 6,328,232 B1 | * | 12/2001 | Haltiner et al. | 239/585.1 |
| 6,390,241 B1 | * | 5/2002 | Nemie, Jr. | 184/105.3 |
| 6,418,912 B1 | * | 7/2002 | Lorraine | 123/470 |
| 6,668,803 B1 | * | 12/2003 | McClean et al. | 123/470 |
| 6,705,010 B1 | * | 3/2004 | Scollard | 29/888.011 |
| 6,705,292 B2 | * | 3/2004 | Bugos | 123/470 |

* cited by examiner

*Primary Examiner*—Carl S. Miller

(57) ABSTRACT

A fuel rail cup is provided with a lead-in volume of one-third a receiving volume of the fuel rail cup that allows insertion of an O-ring mounted on a fuel injector inlet to be inserted at 20 pound-force or less. A method of inserting the fuel injector inlet with an O-ring surrounding the fuel injector inlet into a receiving volume of a fuel rail cup is also provided.

5 Claims, 2 Drawing Sheets

FUEL INJECTOR CUP WITH IMPROVED LEAD-IN DIMENSIONS FOR REDUCED INSERTION FORCE

BACKGROUND OF THE INVENTION

Fuel rail cups are used to mount respective inlets of fuel injectors to a fuel rail. The inlet of the fuel injector typically includes an O-ring mounted about the inlet. The fuel injector inlet is inserted into the fuel rail cup with an axial insertion force that is believed to be greater than about 45 pound-force. Problems may arise when a fuel injector inlet is inserted with the insertion force of such magnitude. If the injectors are inserted manually, the magnitude of the force may be too high for repeated manual operation. If the injectors are inserted by a machine, it is possible that the O-ring may be damaged during insertion because the magnitude of the force is such that the O-ring may be torn or degraded. Moreover, if the insertion force is high, there is more wear and tear on the insertion machine or the machine may simply stop inserting the specific injector.

It would be beneficial to reduce the insertion force required to insert a fuel injector inlet into the fuel rail cup such that there is less likelihood of damage to the O-ring, fuel rail cup inner surfaces or wear and tear on the insertion machine.

SUMMARY OF THE INVENTION

The present invention provides for insertion of a fuel injector with an O-ring mounted thereon to be accomplished with an insertion force of approximately 20 pound-force or less. In particular, a preferred embodiment of the present invention provides for a fuel rail cup. The fuel rail cup comprises a body extending along a longitudinal axis. The body has an outer surface surrounding an inner surface; the inner surface includes a first wall and a second wall. The first wall extends along the longitudinal axis at a first length and about the longitudinal axis to define a receiving volume. The second wall extends oblique to and about the longitudinal axis to define a lead-in volume. The lead-in volume has a second length along the longitudinal axis; the second length being approximately one-third of the first length.

In another preferred embodiment, the present invention provides for a fuel rail cup. The fuel rail cup comprises a body extending along a longitudinal axis. The body has an outer surface surrounding an inner surface; the inner surface includes a first wall and a second wall. The first wall forms a receiving volume adapted to receive an O-ring surrounding a fuel injector inlet. The second wall forms a lead-in volume so that a force required to insert the fuel injector inlet into the lead-in volume towards the receiving volume is generally 20 pound-force or less along the longitudinal axis.

In yet another preferred embodiment, a method of inserting one of a fuel rail cup into a fuel injector or the fuel injector into the fuel rail cup is provided. The fuel rail cup comprises a body. The body has an inner surface extending along a longitudinal axis; the inner surface forms a receiving volume and a lead-in volume being disposed about the longitudinal axis. The receiving volume being defined by a first wall of the inner surface extending generally along the longitudinal axis and the lead in volume being defined by a second wall of the inner surface extending at a first angle relative to the longitudinal axis. The method can be achieved, in part, by locating an O-ring that surrounds the fuel injector inlet in the lead-in volume; and inserting the fuel injector inlet with an insertion force of approximately 20 pound-force or less along the longitudinal axis towards the receiving volume.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
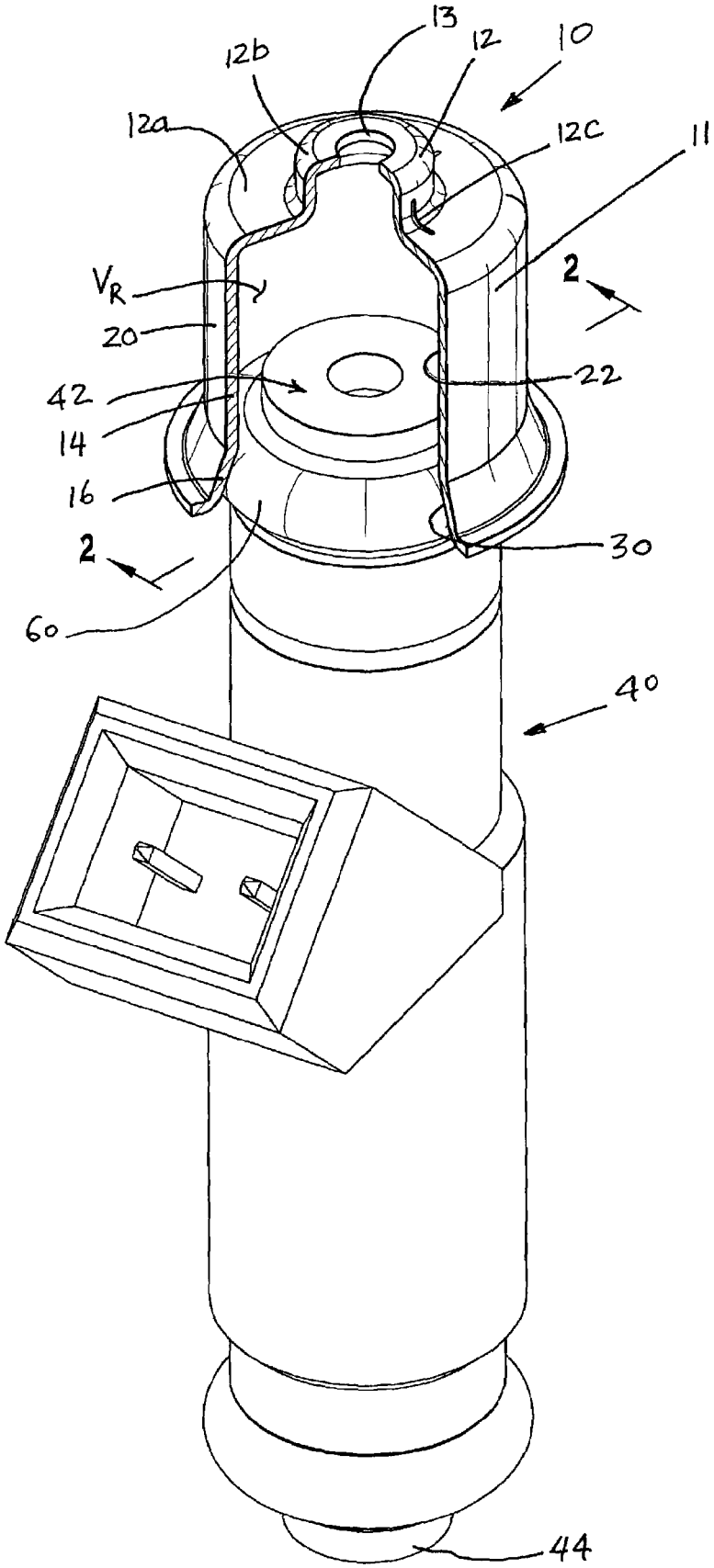
FIG. 1 illustrates a perspective view of the fuel rail cup and the fuel injector inlet prior to application of insertion force along a longitudinal axis according to a preferred embodiment.
Figure 2:
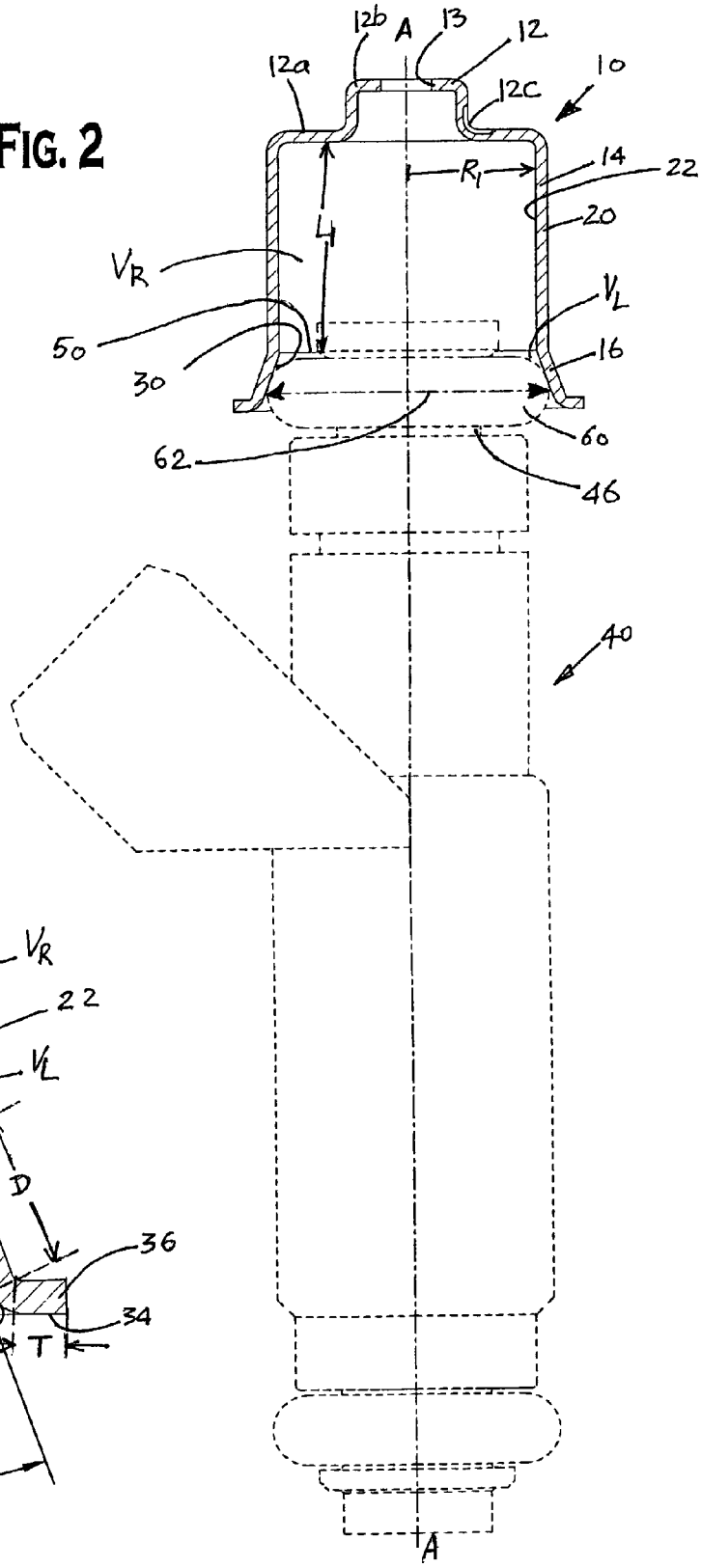
FIG. 2 illustrates a cross-sectional view of the fuel rail cup and the fuel injector inlet according to a preferred embodiment.
Figure 3:
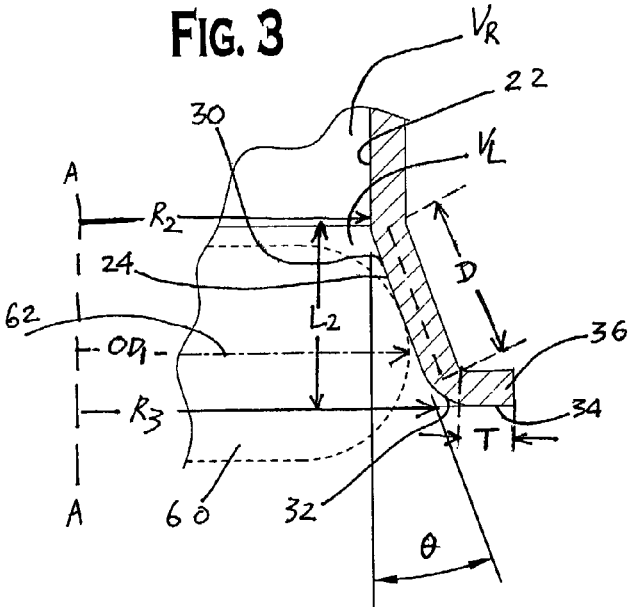
FIG. 3 illustrates a close-up view of a lead-in portion and an O-ring according to a preferred embodiment.

FIGS. 1–3 illustrate the preferred embodiments. In particular, FIG. 1 illustrates a fuel rail cup 10 and a fuel injector 40. The fuel rail cup 10 has a body 11 extending along a longitudinal axis A—A. The body 11 has an inner surface 18 and an outer surface 20 surrounding the inner surface 18. The body 11 also has a fuel feed portion 12, a fuel injector inlet receiving portion 14 and an O-ring lead-in portion 16. The fuel feed portion 12 includes the inner and outer surfaces of the body 20 configured to form a generally planar section 12*a* with a raised nub portion 12*b*. The nub portion 12*b* is provided with an orifice 13 formed through the nub portion 12*b*. At least one groove 12*c* can be formed on both the nub portion and the generally planar portion so as to provide a referential indexing groove during installation of the fuel rail cup 10 to the fuel rail (not shown). Proximate an outer perimeter of the planar portion 12*a*, the inner surface 18 of the body has a first wall 22 extending generally along the longitudinal axis A—A at a first length $L_1$ and spaced at a first transverse radius $R_1$ from the longitudinal axis A—A. The first wall 22 forms a receiving volume $V_R$ by virtue of its configuration about the longitudinal axis A—A. Preferably, the orifice 13 of the nub portion 12*b* is approximately 2.7 millimeters; the first wall 22 extends generally parallel to the longitudinal axis A—A along the first length $L_1$, the first length $L_1$ is approximately 11 millimeters and the first transverse radius $R_1$ is approximately 7 millimeters. And as used herein, the terms "generally" and "approximately" denote that a value can vary up to ±20% of its stated value.

The O-ring lead-in portion 16 has an inner surface 24 co-terminus with the first wall 22 to form a second wall 30. The second wall 30 extends at an oblique angle θ relative to the longitudinal axis A—A through a distance D, which is related, by the trigonometric cosine function of the oblique angle θ, to a virtual length $L_2$ along the longitudinal axis A—A. The second wall 30 forms a lead-in volume $V_L$ by virtue of is configuration about the longitudinal axis A—A. A third wall 32 having a surface of curvature is provided to connect the second wall 30 to the fourth wall 34 that extends in a generally transverse direction to the longitudinal axis A—A. The fourth wall 34 extends from the third wall 32 at a distance T to form a retaining tab 36. The retaining tab 36 can be used to couple the fuel rail cup 10 to an attaching component such as, for example, a fuel cup clip (not shown) that ensures that the fuel injector remains attached to the fuel rail cup after the fuel injector is mounted to an intake manifold of an engine (not shown). Preferably, the second wall 30 extends at an angle θ of approximately 20 degrees relative to the longitudinal axis; the distance D of the second wall 30 is approximately 3.3 millimeters; the length $L_2$ along the longitudinal axis A—A is approximately 3.1 millimeters; and the retaining tabs 36 extend at a distance of approximately 0.8 millimeter. Also preferably, the fuel rail cup is formed by a deep-drawing a stainless steel blank over a die.

By virtue of the second wall 30 extending oblique to and about the longitudinal axis A—A, the second wall 30 forms a lead-in volume $V_L$ in the form of a generally frustoconical portion 50 of a right circular cone. In particular, the frustoconical portion 50 has a second radii $R_2$ and a third radii $R_3$ spaced between length $L_2$ along the longitudinal axis. Using the parameters described above, the volume of the lead-in volume $V_L$ can be determined by the following formula.

$$V_L = \tfrac{1}{3}\pi L_2[R^2{}_2 + R_2R_3 + R^2{}_3]$$

The surface of the second wall 30 proximate the lead-in volume $V_L$ can be polished or coated so as to change the surface characteristics of the second wall 30. The surface characteristics can include a surface roughness or friction coefficient. Coatings such as, for example, zinc, chrome or stainless steel can be provided via an electroplating process to reduce the surface roughness or friction coefficient of the lead-in volume. A polishing process to reduce surface roughness can be utilized alone or in conjunction with a coating. The polishing process can include, for example, specific tumbling media configurations in a tumbling machine so that surface roughness proximate the lead-in volume is decreased from approximately 0.85 $R_a$ micrometers to approximately 0.2 $R_a$ micrometers, as described in copending application Ser. No. 09/340,108 (Method and Apparatus For Reducing the Force Required to Insert a Seal in a Cavity; filed 25 Jun. 1999 and pending), which application is incorporated by reference herein in its entirety. Preferably, the second wall 30 of the lead-in volume or the O-ring 60 can be provided with lubricating oil on the O-ring surface during insertion of the fuel injector 40 into the fuel rail cup 10 alone or in addition to a coating or polishing process.

The fuel injector 40 has a passageway (not shown) extending between an inlet portion 42 and outlet portion 44 along a longitudinal axis A—A. In a preferred embodiment, the fuel injector 40 has a magnetic actuator (not shown) proximate a closure member (not shown) that, when energized, positions the closure member away from a seat (not shown) so as to permit fuel to flow through the outlet portion 44. The fuel injector 40 can include, for example, fuel injectors of the type sets forth in U.S. Pat. No. 5,494,225 issued on Feb. 27, 1996, or the modular fuel injectors set forth in Published U.S. Patent Application No. 2002/0047054 A1, published on Apr. 25, 2002, which is pending, and wherein both of these documents are hereby incorporated by reference in their entireties.

At the inlet portion of the fuel injector 40, an O-ring 60 is disposed in an arcuate relief portion 46 on the fuel injector inlet 42 so as to permit the O-ring 60 to surround a portion of the fuel injector inlet 42. The O-ring 60 has an uninstalled outside diameter OD1 of approximately 14.6 millimeter (as measured on a centroidal plane 62) and can be formed of an elastomeric material that is resistant to fuel such as, for example, nitrile rubber. In order to form a suitable seal between the first wall 22 of the receiving volume $V_L$, the O-ring 60 can be compressed up to 25% along its centroidal plane so that its installed outside diameter (not shown) is approximately 10–15% less than its uninstalled diameter OD1.

It is believed that the amount of force required to compress the O-ring 60 during installation of the fuel injector 40 in the fuel rail cup 10 is related to the insertion force directed along the longitudinal axis that is required to initially compress the O-ring 60 between the lead-in volume and the receiving volume. The compressive force, in the preferred embodiment, is applied evenly over a large a surface of the second wall 30 that is contiguous to the O-ring 60. It has been discovered that by providing a lead-in volume $V_L$ of suitable dimensions, the O-ring 60 can be generally centered so that the centroidal axis 62 is generally perpendicular to longitudinal axis and uniformly disposed about the longitudinal axis, and a lower average insertion force (as applied along the longitudinal axis A—A) can be used to compress the O-ring 60 over a longer duration. Preferably, the centering of the O-ring 60 is accomplished by ensuring that the centroidal plane 62 or a portion of O-ring proximate the centroidal plane is contiguous to the wall surface 30 prior to application of any substantial amount of insertion force.

It has also been determined in laboratory testings that a fuel rail cup 10 of the preferred embodiments requires an average of 16 pound-force (with a standard deviation of approximately 3 pound-force) to insert a fuel injector inlet 42 (with a new and lubricated O-ring 60 for each insertion) for at least 50 insertion cycles of the fuel injector inlet 42 into a fuel rail cup 20. Compared to known fuel rail cup configurations, which require approximately 46 pound-force, the reduction of the average insertion force is approximately 65 percent. Preferably, the lead-in volume $V_L$ is approximately 524 cubic-millimeters or at least approximately greater than one-third of the receiving volume $V_R$, which is approximately 1535 cubic-millimeters. Also preferably, the virtual or second length $L_2$ is at least approximately one-third of the first distance $L_1$ of the receiving volume $V_R$.

During assembly, the O-ring 60 can be coated with a lubricating oil and placed into an insertion machine (not shown). A fuel rail cup 10 of the preferred embodiment is provided with a lead-in volume $V_L$. The O-ring is located in the lead-in volume $V_L$. An insertion force of 20 pound-force or less, in a preferred embodiment, is applied along the longitudinal axis in an upward direction with the fuel rail cup 20 being stationary or in a downward direction with the fuel injector 40 being stationary so that the O-ring 60 and the fuel injector inlet is inserted through the lead-in volume $V_L$ to the receiving volume $V_R$.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What we claim is:

1. A fuel rail cup comprising:

a body extending along a longitudinal axis, the body having an outer surface surrounding an inner surface, the inner surface including a first wall and a second wall, the first wall extending along the longitudinal axis at a first length and about the longitudinal axis to define a receiving volume, the second wall extending oblique to and about the longitudinal axis to define a lead-in volume, the lead-in volume having a second length along the longitudinal axis, the second length being approximately one-third of the first length; and wherein a lead-in portion is coated with an anti-friction coating or plating that provides a surface roughness of 0.85 Ra micrometers of the second wall of the lead-in volume.

2. A fuel rail cup comprising:

a body extending along a longitudinal axis, the body having an outer surface surrounding an inner surface, the inner surface including a first wall and a second wall, the first wall extending along the longitudinal axis at a first length and about the longitudinal axis to define a receiving volume, the second wall extending oblique to and about the longitudinal axis to define a lead-in volume, the lead-in volume having a second length along the longitudinal axis, the second length being approximately one-third of the first length; and wherein the surface roughness of the fuel rail cup comprises a surface roughness of approximately 0.2 Ra micrometers.

3. A method of inserting a fuel injector inlet in a fuel rail cup, the fuel rail cup including a body having an inner surface extending along a longitudinal axis, the inner surface forming a receiving volume and a lead-in volume being disposed about the longitudinal axis, the receiving volume being defined by a first wall of the inner surface extending generally along the longitudinal axis and the lead in volume being defined by a second wall of the inner surface extending at a first angle relative to the longitudinal axis, the method comprising:

locating an O-ring that surrounds the fuel injector inlet in the lead-in volume; and inserting the fuel injector inlet with an insertion force of approximately 20 pound-force or less along the longitudinal axis towards the receiving volume, the inserting comprising changing a surface roughness of the wall surfaces proximate the lead-in volume.

4. The method of claim 3, wherein the changing comprises at least one of polishing and coating the wall surfaces proximate the lead-in volume.

5. The method of claim 3, wherein the inserting comprises repeatedly inserting the fuel injector inlet in the fuel rail cup over fifty cycles, each cycle including providing a new and lubricated O-ring prior to each insertion cycle such that an average insertion force over the fifty cycles is less than 20 pound-force.

* * * * *